US010294536B2

(12) United States Patent
Sommer et al.

(10) Patent No.: US 10,294,536 B2
(45) Date of Patent: May 21, 2019

(54) COOLING ELEMENT WITH SPACER

(71) Applicant: voestalpine Metal Forming GmbH, Krems an der Donau (AT)

(72) Inventors: Andreas Sommer, Crailsheim (DE); Tobias Hägele, Schwäbisch Gmünd (DE); Reiner Kelsch, Mutlangen (DE); Dieter Hartmann, Mutlangen (DE)

(73) Assignee: voestalpine Metal Forming GmbH, Krems an der Donau (AT)

( * ) Notice: Subject to any disclaimer, the term of this patent is extended or adjusted under 35 U.S.C. 154(b) by 916 days.

(21) Appl. No.: 14/340,935

(22) Filed: Jul. 25, 2014

(65) Prior Publication Data

US 2015/0027601 A1 Jan. 29, 2015

(30) Foreign Application Priority Data

Jul. 26, 2013 (DE) ..... 10 2013 108 044

(51) Int. Cl.
*B21D 53/88* (2006.01)
*C21D 8/02* (2006.01)
(Continued)

(52) U.S. Cl.
CPC ..... *C21D 8/0247* (2013.01); *B21D 22/022* (2013.01); *B21D 22/208* (2013.01);
(Continued)

(58) Field of Classification Search
CPC ..... B21D 22/02; B21D 22/022; B21D 22/20; B21D 22/208; B21D 37/16; B21D 53/88; C21D 1/62; C21D 1/673; C21D 9/00; C21D 9/0025; C21D 9/0056; C21D 8/0247; C21D 8/0294; F27D 2009/0089
See application file for complete search history.

(56) References Cited

U.S. PATENT DOCUMENTS 3,349,477 A * 10/1967 Searles ..... H02K 49/043 148/201
3,534,947 A * 10/1970 Lenz ..... C21D 1/673 266/117
(Continued)

FOREIGN PATENT DOCUMENTS

DE 102008063985 A1 * 7/2010 ..... C21D 8/02
DE 102009015013 B4 5/2011
DE 102009052210 B4 8/2012

OTHER PUBLICATIONS

Translation, DE 102008063985 A1, Jul. 8, 2010.*

*Primary Examiner* — Edward T Tolan

(57) ABSTRACT

A method for producing partially hardened steel components in which a blank composed of a hardenable sheet steel is subjected to a temperature increase and shaped into a component; the component is transferred to a tool in which the heated component is cooled and thus quench hardened; during the heating of the blank or component in order to achieve the temperature increase to a temperature required for the hardening in regions that are to have a lower hardness and/or higher ductility, cooling elements are spaced apart from the surface by a small gap; the cooling element is dimensioned so that the thermal energy acting on the region that remains ductile flows through the component into the cooling element, characterized in that in order to space the cooling element apart from the component, micro-nubs or knobs are used, which are distributed over the area of the cooling element.

17 Claims, 6 Drawing Sheets

(51) Int. Cl.

| | |
|---|---|
| ***C21D 1/673*** | (2006.01) |
| ***B21D 22/02*** | (2006.01) |
| ***B21D 22/20*** | (2006.01) |
| ***C21D 9/00*** | (2006.01) |
| *C21D 1/18* | (2006.01) |

(52) U.S. Cl.

CPC ..... *B21D 53/88* (2013.01); *C21D 1/673* (2013.01); *C21D 8/0294* (2013.01); *C21D 9/0068* (2013.01); *C21D 1/18* (2013.01); *C21D 2221/00* (2013.01)

(56) References Cited

U.S. PATENT DOCUMENTS 4,938,456 A * 7/1990 Richards ..... C21B 7/10 266/193
8,272,245 B2 * 9/2012 Salamon ..... B21D 22/02 72/342.2
2004/0083786 A1 * 5/2004 Garnett ..... B21D 22/02 72/348
2009/0211669 A1 * 8/2009 Vehof ..... B21D 22/26 148/654
2011/0219849 A1 * 9/2011 Kuriso ..... B21D 22/022 72/427
2012/0097298 A1 4/2012 Sommer et al.
2012/0304448 A1 12/2012 Hartmann et al.
2014/0069162 A1 * 3/2014 Fukuchi ..... B21D 22/208 72/342.2
2014/0096585 A1 * 4/2014 Locker ..... B21D 22/022 72/476
2014/0130564 A1 * 5/2014 Suzuki ..... B21J 1/06 72/342.5
2014/0137619 A1 * 5/2014 Asano ..... B21D 22/208 72/38
2014/0302341 A1 * 10/2014 Egawa ..... B21D 22/022 428/600
2015/0107325 A1 * 4/2015 Glueck ..... B21D 37/16 72/342.3

* cited by examiner

COOLING ELEMENT WITH SPACER

FIELD OF THE INVENTION

The invention relates to a method for producing components out of sheet steel.

BACKGROUND OF THE INVENTION

Sheet metal products, in particular made of sheet steel, that vary in thickness and material quality are seeing increasing use in automotive production. It is thus possible to reduce the weight of body parts in line with their function. Body parts of this kind include, for example, A-, B-, and C pillars, bumpers and their cross members, roof frames, side impact beams, vehicle body shells, etc.

In this context, the prior art technique is to use so-called tailored blanks. These are blanks that are welded together out of a plurality of pieces of sheet metal with the same or different sheet thicknesses and material qualities. It is also possible to use so-called patchwork blanks. These are sheets of varying thicknesses and material qualities that are placed parallel to one another.

In the latter process, the sheets are placed onto one another and then joined to one another, in particular by means of spot welding.

Patchwork blanks have the disadvantage that the spot welded connections are subjected to powerful stresses during the shaping and can possibly also fracture. In addition, the gap that is present between the sheet metal layers can lead to corrosion problems that require a costly sealing to control. In addition, the transition between the individual thickness regions is relatively abrupt in both tailored blanks and patchwork blanks. As a result, when stress is exerted, undesirable stress concentrations can occur in the immediate transition region.

Although tailored and patchwork blanks do in fact permit achievement of a significant weight reduction, the corrosion protection is relatively costly.

DE 10 2009 052 210 B4 has disclosed a method for producing components out of sheet steel with regions of different ductility; a sheet metal blank composed of a hardenable steel alloy is either used to produce a component by means of deep drawing and the deep-drawn component is then at least partially austenitized by means of a heat treatment and then quench hardened in a tool or the blank is at least partially austenitized by means of a heat treatment and shaped in a hot state and is quench hardened then or thereafter; the sheet metal blank has a zinc-based cathodic corrosion protection coating; in regions of a desired higher ductility of the component, at least one other sheet is placed against the blank so that during the heat treatment, the blank is heated less in this region than in the remaining region.

The object of the invention is to create a method for producing partially hardened components out of hardenable sheet steel in which the coating of the sheet steel is not damaged or is only insignificantly damaged and a uniform hardness or ductility progression over the desired region is achieved while exerting as little stress as possible on the cooling element.

Another object of the invention is to create a method for producing partially hardened components out of hardenable sheet steel in which the risk of damage to the components on the one hand and/or to the cooling element and/or to the furnace support is minimized by facilitating the removal of and the ability to position the components.

Another object of the invention is to create a device for carrying out the method, which can be reliably used to provide ductile regions without damaging the surface of the steel component.

SUMMARY OF THE INVENTION

According to the invention, in the regions that are to have little or no hardness, during the heating, a cooling element is placed against the blank, spaced a slight distance apart from the latter, in particular with a spacing of 0.1 to 2.5 mm, in particular from 0.5 to 2 mm, between the cooling element and the blank.

The cooling element is a "cold" body that rests against the hot blank during the furnace process. Through the narrow gap, this body absorbs energy from the blank via radiation. In the context of the invention, heat transmission includes thermal radiation across a narrow gap. In other words, from the blank, the body absorbs part of the energy that has been introduced by the furnace. For this reason, a "cold" body is also referred to as a cooling element. Thus with the invention, a flow of heat from the furnace chamber, through the sheet metal of the component, and into the cooling element takes place. No insulation takes place.

According to the invention, the components are partly not or—only briefly—brought to a temperature greater than the austenitizing start temperature during the heating process. As a result, the material in these regions is not or is only partially converted into austenite and therefore cannot transform into martensite in these regions during the pressing procedure (press hardening). The regions that do not transform into martensite during the press hardening due to the prior heat treatment have a significantly lower strength than the regions that were brought to temperatures above the austenitization temperature during the heat treatment and then hardened in the press.

This partial non-austenitization/partial austenitization is achieved in that at the start of the heat treatment (before the component comes into the furnace), the cooling element is partially placed against the component. The cooling element partially replicates the shape of the component. During the transport through the furnace, this relatively large cooling element does not heat up anywhere near as much as the component. As a result, energy is absorbed from the component (energy flow always travels from warm to cold). The component therefore heats up much more slowly and to a lower temperature in these regions than in the remaining regions against which the body does not rest.

The soft regions can be selectively adjusted by means of the cooling element resting against the component. With the same overlap area, but different thicknesses of the cooling element (even across its expanse), it is possible to achieve different strengths. It is thus possible to set almost any strength between 500 and 1,500 MPa, in fact only by varying the shape and in particular thickness of the cooling element and by varying the material (even across its expanse) out of which the absorption mass is produced. The strength transition range between the hard and soft material is approx. 20 to 50 mm, in particular 20 to 30 mm In addition, air gaps, particularly in the edge region, can be provided in order to make the hardness transition wider or narrower, depending on the embodiment.

In order to make this process reliable, it is necessary to ensure that the cooling element always has a sufficiently low temperature before traveling into the furnace again. In the series process, this can be implemented in various ways during the return of the furnace support. For example, during the return, the cooling element can be actively cooled (e.g. by means of water cooling) or passively cooled (e.g. in ambient air). In addition, the design and dimensions of the cooling element or cooling elements can be selected so that they are composed of a plurality of thin "fins" that can be cooled more quickly and efficiently during the return.

The partial non-austenitization/partial austenitization according to the invention is assured as long as the temperature of the surfaces of the cooling element oriented toward the component does not exceed a particular value. To expand the process window and to achieve the accompanying reduction in the scrap ratio, e.g. in the event of interruptions in production, the cooling element can be embodied so that heat is already being conveyed out of it during its passage through the furnace so that the temperature of its surfaces oriented toward the component remains sufficiently low even with long sojourn times in the furnace. This can be achieved, for example, by flushing "cold" air through the cooling element from outside the furnace chamber.

A large, precisely controllable, homogeneous transition region from hard to soft makes it possible, for example, for the component to absorb the stresses that occur in the event of a crash homogeneously in the transition region from hard to soft and to provide a "soft" cushion, thus preventing a component from being too powerfully stressed and possibly fracturing during the crash and resulting in component failure.

With certain component geometries, a larger transition region also prevents the component from fracturing in the region of spot welds produced in the body shell.

It is likewise possible, through precisely defined ductile regions with small transition regions, e.g. in the vicinity of spot welds, to influence the behavior of the component in a crash in an exact, precisely positioned way.

In order to reduce the heating of the cooling element by the remaining furnace wall radiation, heat shield plates can be advantageously provided on the sides of the cooling element oriented away from the component. These heat shield plates can be produced from various materials, in particular out of ceramic or metallic materials.

In addition, correspondingly selected emissivities (surface condition, coating, paint) can be used to selectively control the heat absorption of the cooling element and/or of the heat shield plates due to the radiation from the furnace chamber. The cooling element can also be used to selectively influence the heat absorption due to the radiation of the blank.

According to the invention, the cooling element is kept a slight distance apart from the sheet metal. It has turned out that the slight gap of 0.1 to 2.0 mm has no negative impact on the heat transmission, i.e. the conveyance of heat from the furnace, through the blank, and into the cooling element.

In methods according to the prior art, it is disadvantageous that the bodies mentioned therein rest directly against the component. It has turned out that such methods have a significant negative impact on the galvanized surface of the sheet steel. In particular, the zinc comes loose from the surface of the sheet steel so that a corrosion protection and in particular, a cathodic corrosion protection, is no longer assured. This zinc, moreover, is disadvantageously transferred to the cooling element so that the cooling element becomes contaminated and/or it becomes difficult to remove the component from the cooling element after they pass through the furnace.

It has also turned out to be disadvantageous that an increased risk of irregularity of component properties due to the uncontrolled transmission of heat between the cooling element and the component or blank, caused by the overlap between the desirable transmission of heat due to thermal radiation—which transmission is robust in comparison to spacing changes—and the undesirable, uncontrolled transmission of heat due to the conduction of heat in the uncontrollably touching regions.

This uncontrollable contact primarily occurs due to irregular swelling effects of cold-formed components (indirect process) and torsion effects of components (indirect process) and blanks (direct hot forming) during the heating ("warping" and, with increasing sojourn time in the furnace, "softening").

It has surprisingly turned out that the arrangement according to the invention of a few spacers, for example welded-on micro-nubs or knobs on the surface of the cooling elements completely eliminates these disadvantages, does not significantly affect the transmission of heat due to the small contact area involved, and do not cause any removal of material.

The spacers according to the invention, for example micro-nubs or knobs, protrude approximately 0.1 to 2.00 mm from the surface of the absorption mass and in particular, can taper from their broad base, which rests against the absorption mass or is composed of the latter, toward the contact surface. The contact surface is preferably pointed or rounded with a small radius so that a very small contact surface is produced.

This small contact surface ensures that no significant heat transmission occurs thereby; this contact surface also results in the fact that no zinc deposits are observed on the cooling element and no zinc losses are observed on the formed part.

It is also surprising that an arrangement of such micro-nubs provides sufficient support for the component and no apparent warping of the component occurs.

According to the invention, the contact surface of the spacer on the component is selected so that it makes up at most 1.5% of the total surface area.

In another embodiment, an air cushion is used instead of spacers. To achieve this, air outlet elements are provided over the area of the cooling element, which are connected to an air supply line or some other gas supply line. The arrangement of the air outlet elements and their number depend on the weight of the part; the number and distribution of the air outlet elements on the one hand and the air pressure (gas pressure) on the other are matched to each other so as to achieve a reliable lifting of the component away from the cooling element.

In this connection, the gas or air used can come into the cooling element at a lower temperature than the furnace temperature, but should at least not heat up the cooling element, thus ensuring the flow of radiation heat from the component to the cooling element.

The gas is advantageously even used to cool the cooling element.

In another advantageous embodiment in which the cooling element is composed of cooling fins, a corresponding air cushion can be produced in that pressurized gas is supplied between the fins to the underside of the work piece. To this end, the cooling fins can, for example, be combined in a box so that an outer wall is produced, which prevents the gas from flowing off to the outside. The pressurized gas or pressurized air can then be supplied to this box.

BRIEF DESCRIPTION OF THE DRAWINGS

The invention will be explained in detail by way of example in conjunction with the drawings.

DETAILED DESCRIPTION OF THE PREFERRED EMBODIMENTS

Figure 1:
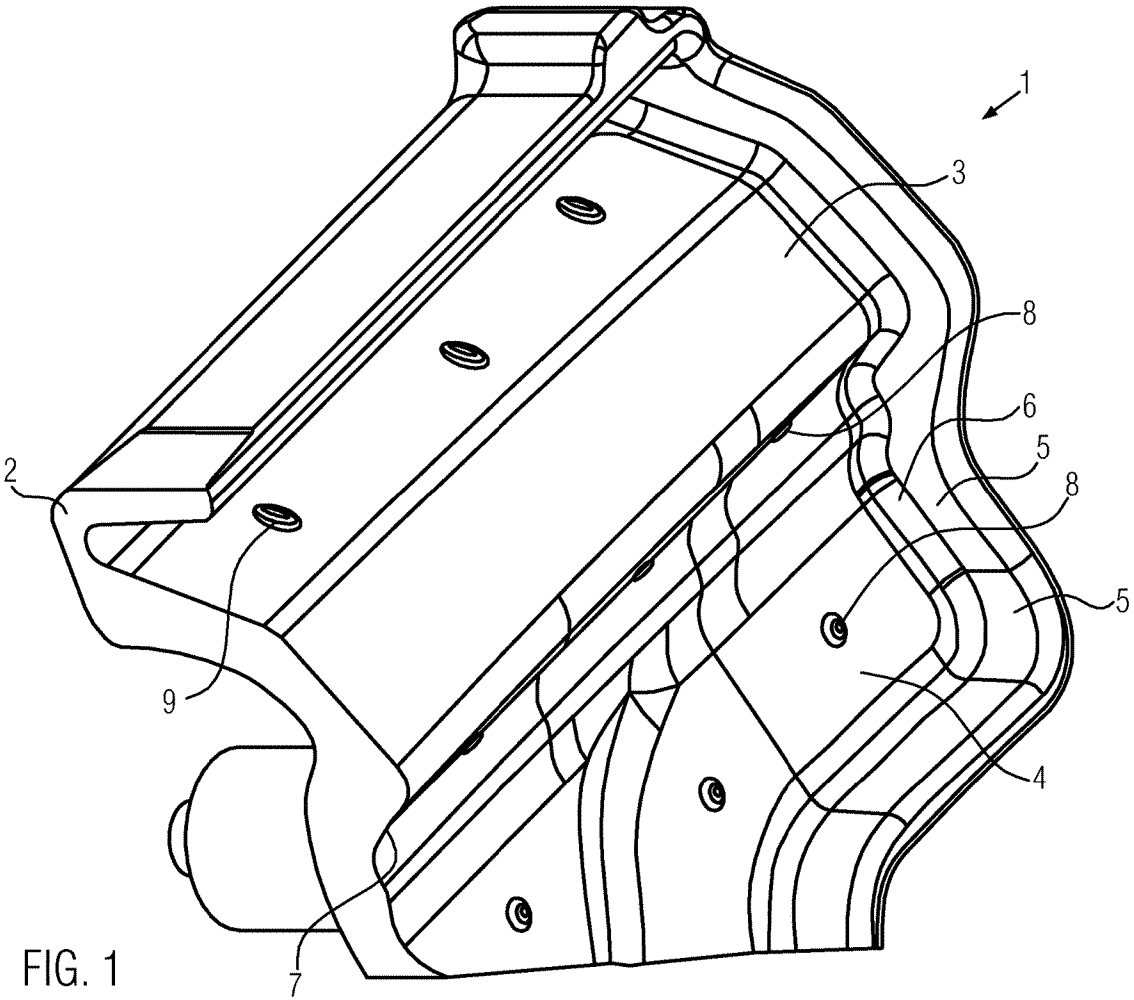
FIG. 1 is a schematic top view of a cooling element according to the invention.
Figure 2:
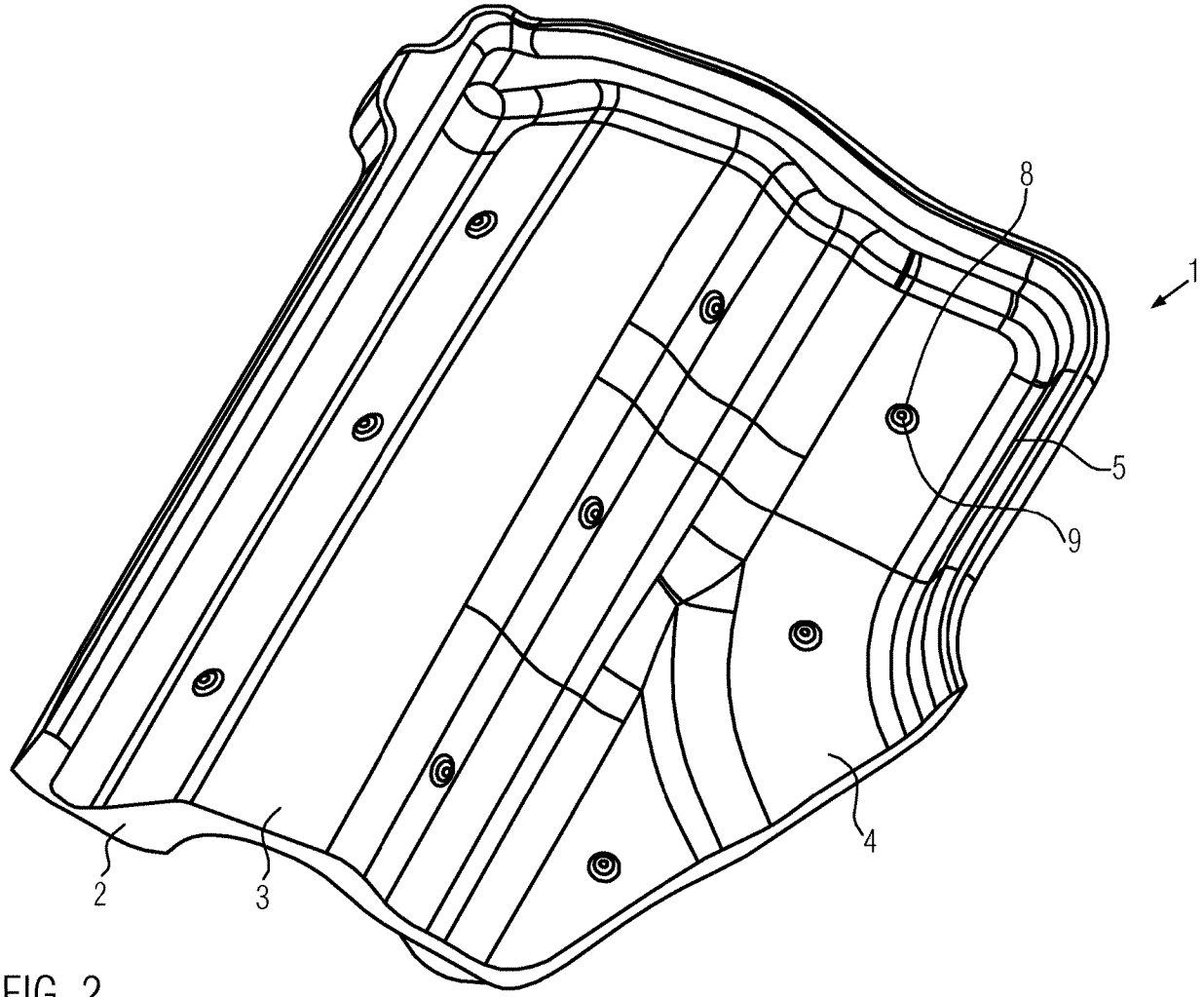
FIG. 2 shows the cooling element from FIG. 1, viewed from a different angle.

A cooling element 1 according to the invention has an in particular metallic body 2, particularly composed of a thermally conductive metallic alloy. The cooling element 1 has a working surface 3 which is oriented toward a component to be heated. The working surface has an outline that essentially corresponds to that of the component to be heated; this outline contains surfaces 4, grooves 5, and positive radii 6 as well as negative radii 7. In particular on the surfaces 4, the spacers according to the invention are embodied in the form of micro-nubs 8 or knobs 8. Starting from a surface 4, the knobs 8 have a first width and taper toward a component to be placed against them, reaching a contact surface 9 against which the component rests. The micro-nubs or knobs 8 in this case can be embodied as anything from flat to dome-shaped to sharply conical.

Regardless of the shape—for example, linear protrusions are also Conceivable—it is important that there be as small as possible a contact surface of the spacers, e.g. micro-nubs or knobs, relative to the component; the height of the knobs starting from the flat surface of the cooling element is 0.2 to 2 mm.

The micro-nubs or knobs can be composed of the same material as the cooling element and in particular, can be embodied of one piece with the cooling element e.g. produced through material-removing machining. The micro-nubs or knobs can also be very easily attached to the cooling element by means of build-up welding. In addition, the vicinity of the micro-nubs or knobs, bores can be provided in the cooling element; starting from their base, the micro-nubs have an axially extending shaft, which corresponds to the bore (not shown) and with which the micro-nubs 8 or knobs 8 are inserted into the cooling element 1.

Such micro-nubs or knobs (8) with a shaft (not shown) can also be composed of a different material, in particular ceramic, other metal alloys, or other metals.

In an embodiment of the cooling element 1 with fins 10, the corresponding work surface 3 is primarily composed of the tops 11; in this case, the knobs 8 or micro-nubs 8 are likewise distributed in a suitable fashion, for example are only situated on only some of the tops 11 of the fins 10. The fins 10 are secured to one another with suitable elements such as clamps 12 or the like.

Figure 3:
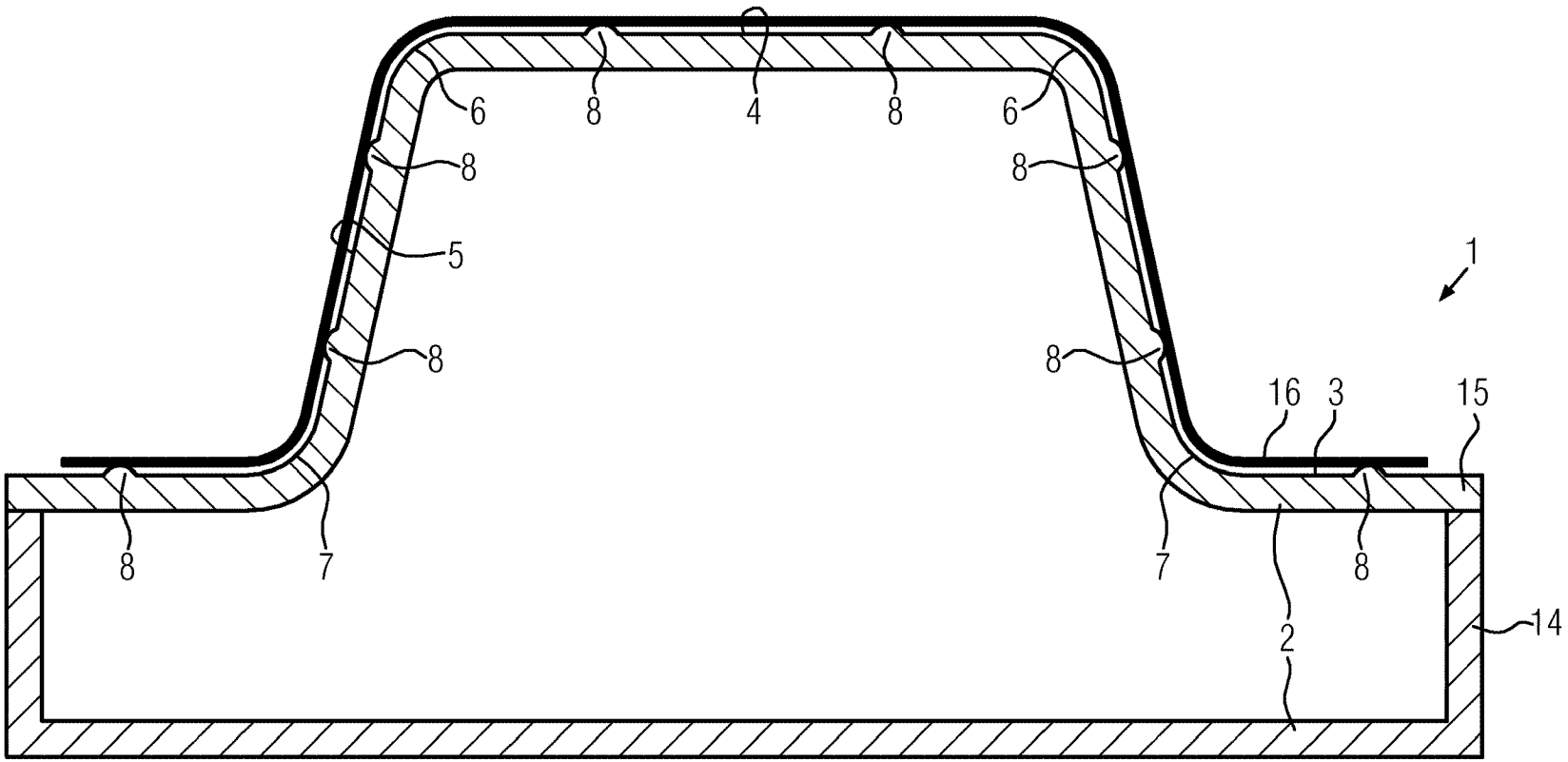
FIG. 3 is a very schematic sectional view of a cooling element according to the invention.

The cooling element can also be embodied as hollow or box-like (FIG. 3); the cooling element 1 has a box base body 14 and a working surface element 15 placed onto the latter.

In another advantageous embodiment, the spacing of the work piece 16 is embodied in that the work piece 16 is spaced apart from the work surface 3 with a small gap 17 by means of an air cushion. To this end, the work surface 3 is provided with bores 18 which with a box-like embodiment of the cooling element 1 extend into the hollow interior of the box 19. The hollow box interior 19 in this case is preferably acted on with pressurized gas, which flows out of the bores 18 into the gap 17 with a flow speed and pressure such that a component 16 does not touch the work surface 3. In particular, the temperature of the gas in this case can be adjusted and especially, can be introduced into the cavity 19 at a predetermined temperature. After the component 16 is removed from the working surface 3 and the cooling element is returned to a furnace entrance, the cavity 19 can be flushed with a very cold gas, which flows out through the openings 18 and thus in particular produces a cooling of the entire cooling element.

This flushing and the resulting cooling can advantageously also take place during the passage through the furnace.

Figure 4:
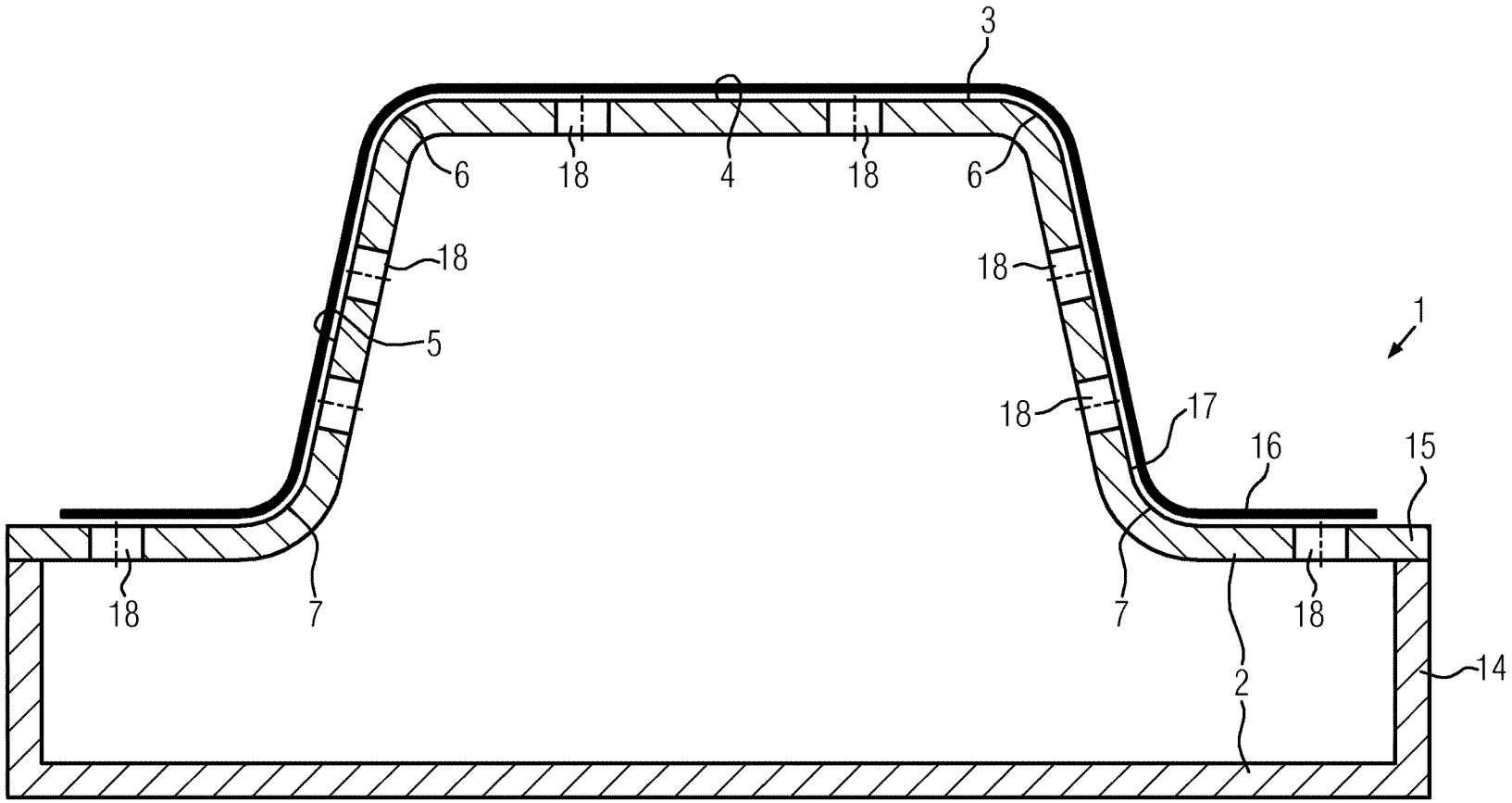
FIG. 4 is a schematic sectional view of another embodiment of the cooling element, with air outlets for producing an air cushion.
Figure 5:
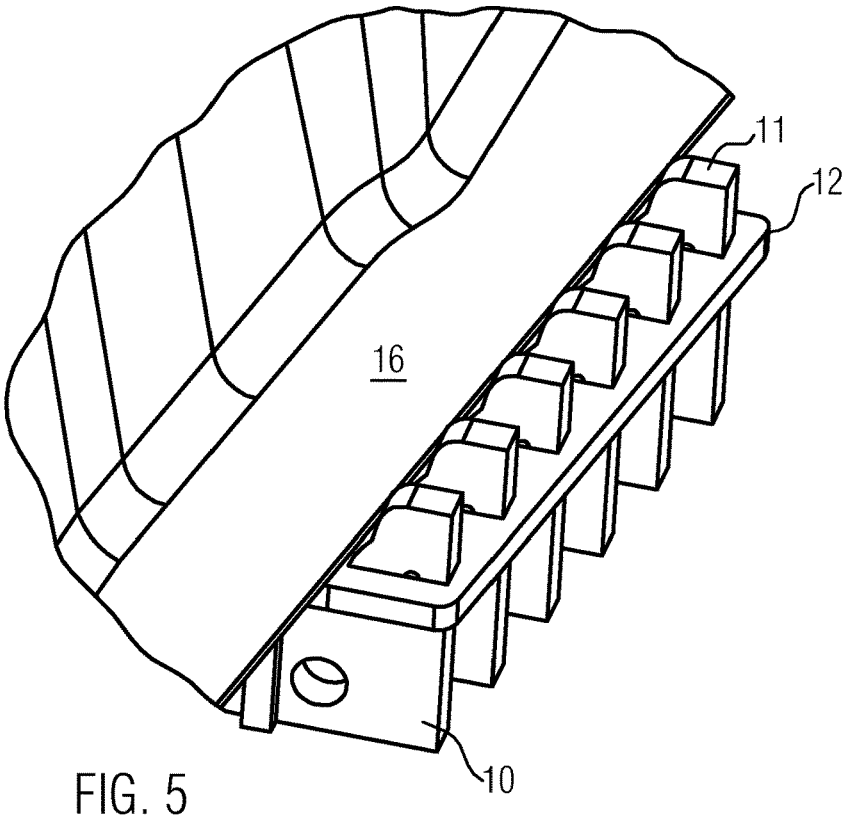
FIG. 5 shows a perspective view of a cooling element with a fin structure and a component resting against it.
Figure 6:
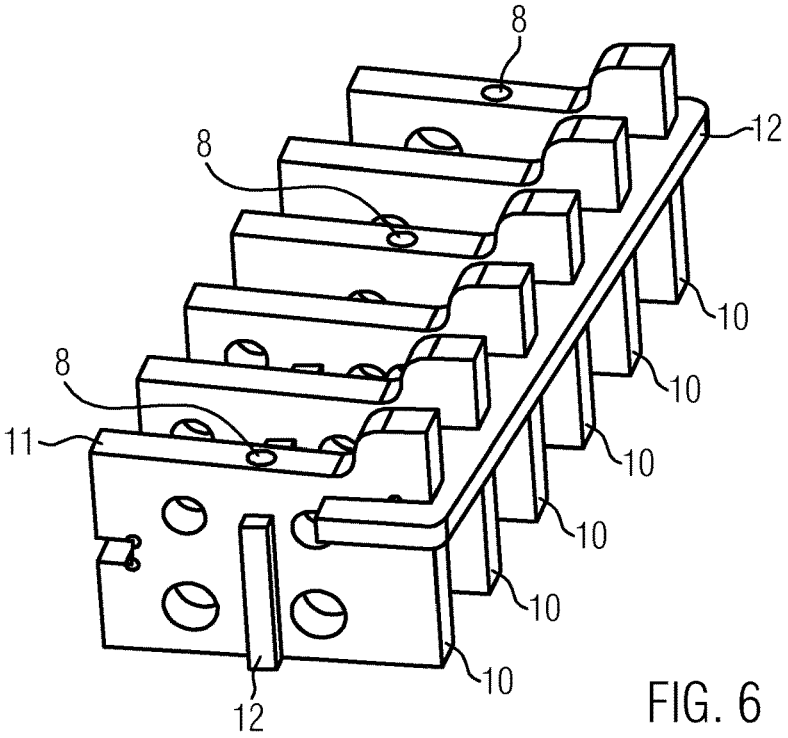
FIG. 6 shows the cooling element according to FIG. 5, without the component resting against it.
Figure 7:
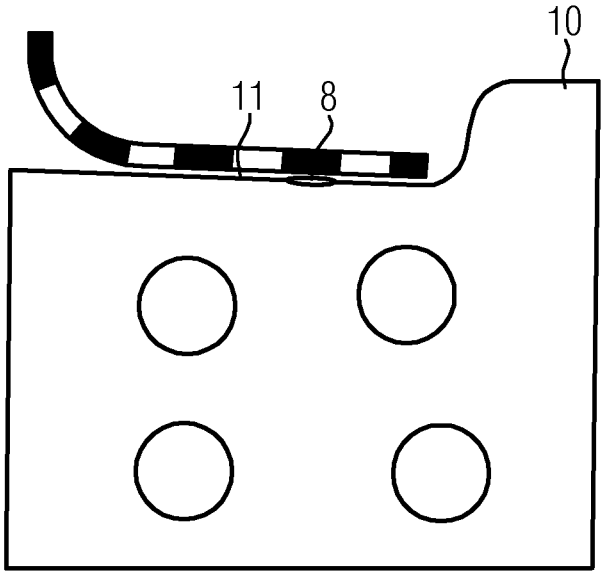
FIG. 7 shows a side view of the cooling element according to FIG. 5, with a part of a component resting against it.
Figure 8:
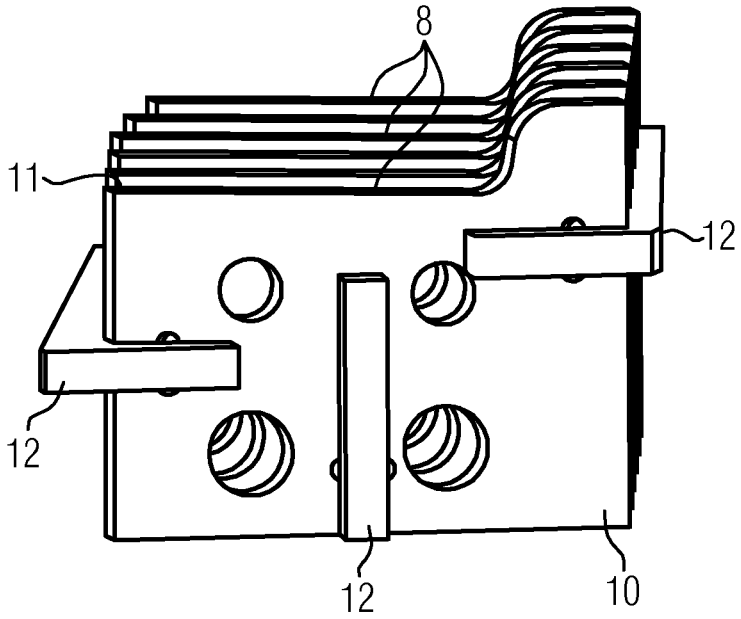
FIG. 8 shows the cooling element according to FIG. 6 from another perspective.

The cavity 19 in this case can be embodied as though composed of plate-like elements (FIG. 4) 15, 14, but the cooling element can also be embodied as largely solid, with a bore (not shown) that extends through the cooling element 1 and can lead from the distributor bores to the bores 18. A cooling element of this kind is significantly more solid and therefore has a higher heat capacity.

The invention claimed is:

1. A method for producing partially hardened steel components, comprising:

partially spacing at least one cooling element apart from a surface of a blank by a small gap, wherein the blank is composed of a hardenable sheet steel, and the at least one cooling element is positioned near regions of the blank that are to have a lower hardness and/or higher ductility;

using locally delimited point-shaped or linear spacers—comprising micro-nubs or knobs—distributed over an area of the at least one cooling element in order to space the at least one cooling element apart from the blank, wherein the spacers are positioned on top surfaces of at least some of a plurality of cooling fins;

heating the blank by transporting the blank and the at least one cooling element through a furnace in order to achieve a temperature of the blank required for partial hardening, wherein the at least one cooling element is dimensioned with regard to its expanse and thickness, its thermal conductivity, and its heat capacity and/or with regard to its emissivity so that thermal energy acting on a region that remains ductile is transmitted through the blank into the at least one cooling element;

after reaching a desired temperature of the blank, transferring the heated blank to a forming tool; and shaping the heated blank into a component while simultaneously partially quench-hardening the heated blank.

2. The method according to claim 1, comprising using a cooling element composed of a heat-resistant metal; wherein the cooling element is embodied with at least one surface whose outline is embodied so that it is spaced apart from the blank by the micro-nubs or knobs with a small gap, in particular a gap 0.1 mm to 2.5 mm wide.

3. A device for producing partially hardened steel components comprising:

a cooling element for the production of partially hardened steel components, the cooling element comprising a plurality of cooling fins, and micro-nubs or knobs, which are distributed over top surfaces of at least some of the fins in order to space the blank to be heated apart from the cooling element, wherein the micro-nubs or micro-knobs protrude from a respective surface of the cooling element by 0.1 to 2.5 mm;

a furnace through which the cooling element is transported during the heating of the blank;

a device for transporting the cooling element and a blank thereon through the furnace;

a forming tool; and a device for transferring the heated blank to the forming tool;

partially spacing at least one cooling element apart from a surface of a blank by a small gap, wherein the blank is composed of a hardenable sheet steel, and the at least one cooling element is positioned near regions of the blank that are to have a lower hardness and/or higher ductility;

using locally delimited point-shaped or linear spacers—comprising the micro-nubs or knobs—distributed over an area of the at least one cooling element in order to space the at least one cooling element apart from the blank, wherein the spacers are positioned on top surfaces of at least some of a plurality of cooling fins;

heating the blank by transporting the blank and the at least one cooling element through the furnace in order to achieve a temperature of the blank required for partial hardening, wherein the at least one cooling element is dimensioned with regard to its expanse and thickness, its thermal conductivity, and its heat capacity and/or with regard to its emissivity so that thermal energy acting on a region that remains ductile is transmitted through the blank into the at least one cooling element;

after reaching a desired temperature of the blank, transferring the heated blank to the forming tool; and shaping the heated blank into a component while simultaneously partially quench-hardening the heated blank.

4. The device according to claim 3, wherein the micro-nubs or knobs are embodied of one piece with the cooling element or are inserted with a shaft into corresponding bores of the cooling element; and the inserted micro-nubs or knobs are composed of a metal, a metal alloy, or a ceramic.

5. The device according to claim 3, wherein contact surfaces, which are embodied at a free end of the micro-nubs or knobs and are for a blank to be heated, are embodied so that less than 1.5% of the area of the blank is contacted by the micro-nubs or knobs.

6. The device according to claim 3, further comprising air outlet elements that are distributed over the area of the cooling element and the air outlet elements are connected to at least one air supply line or a supply line for another gas.

7. The device according to claim 6, wherein an arrangement of air outlet elements and their number depend on a weight of the blank; and wherein the number and distribution of the air outlet elements and the air pressure are matched to each other so as to ensure a reliable lifting of the blank away from the cooling element.

8. The device according to claim 3, wherein the cooling fins are positioned in a box in such a way that an outer wall is formed, which prevents gas from flowing outward or downward; and further comprising an air cushion produced in such a way that pressurized gas is supplied between the fins to an underside of the blank or component.

9. A method for producing partially hardened steel components, comprising:

cold forming a blank composed of a hardenable sheet steel into a component;

partially spacing at least one cooling element apart from a surface of the component by a small gap, wherein the at least one cooling element is positioned near regions of the component that are to have a lower hardness and/or higher ductility;

using locally delimited point-shaped or linear spacers—comprising micro-nubs or knobs—distributed over an area of the at least one cooling element in order to space the at least one cooling element apart from the component, wherein the spacers are positioned on top surfaces of at least some of a plurality of cooling fins;

heating the component by transporting the component and the at least one cooling element through a furnace in order to achieve a temperature of the component required for partial hardening, wherein the at least one cooling element is dimensioned with regard to its expanse and thickness, its thermal conductivity, and its heat capacity and/or with regard to its emissivity so that thermal energy acting on a region that remains ductile is transmitted through the component into the at least one cooling element;

after reaching a desired temperature of the component, transferring the heated component to a tool in which the heated component is simultaneously cooled and thus partially quench-hardened.

10. The method according to claim 1, comprising partially not, or only briefly, bringing the blank to a temperature greater than an austenitizing start temperature during the heating process.

11. The method according to claim 9, comprising using a cooling element composed of a heat-resistant metal; wherein the cooling element is embodied with at least one surface whose outline is embodied so that it is spaced apart from the component by the micro-nubs or knobs with a small gap, in particular a gap 0.1 mm to 2.5 mm wide.

12. A device for producing partially hardened steel component, comprising:

a forming tool;

a cooling element for the production of partially hardened steel components, the cooling element comprising a plurality of cooling fins, and micro-nubs or knobs, which are distributed over top surfaces of at least some of the fins in order to space the component to be heated apart from the cooling element, wherein the micro-nubs or micro-knobs protrude from a respective surface of the cooling element by 0.1 to 2.5 mm;

a furnace through which the cooling element is transported during the heating of the component;

a device for transporting the cooling element and a blank thereon through the furnace;

a tool for simultaneously cooling and partially quench-hardening the blank; and a device for transferring the heated blank to the cooling and quench-hardening tool;

cold forming a blank composed of a hardenable sheet steel into a component;

partially spacing at least one cooling element apart from a surface of the component by a small gap, wherein the at least one cooling element is positioned near regions of the component that are to have a lower hardness and/or higher ductility;

using locally delimited point-shaped or linear spacers—comprising the micro-nubs or knobs—distributed over an area of the at least one cooling element in order to space the at least one cooling element apart from the component, wherein the spacers are positioned on top surfaces of at least some of a plurality of cooling fins;

heating the component by transporting the component and the at least one cooling element through the furnace in order to achieve a temperature of the component required for partial hardening, wherein the at least one cooling element is dimensioned with regard to its expanse and thickness, its thermal conductivity, and its heat capacity and/or with regard to its emissivity so that thermal energy acting on a region that remains ductile is transmitted through the component into the at least one cooling element;

after reaching a desired temperature of the component, transferring the heated component to a tool in which the heated component is simultaneously cooled and thus partially quench-hardened.

13. The device according to claim 12, wherein the micro-nubs or knobs are embodied of one piece with the cooling element or are inserted with a shaft into corresponding bores of the cooling element; and the inserted micro-nubs or knobs are composed of a metal, a metal alloy, or a ceramic.

14. The device according to claim 12, wherein contact surfaces, which are embodied at a free end of the micro-nubs or knobs and are for a component to be heated, are embodied so that less than 1.5% of the area of the component is contacted by the micro-nubs or knobs.

15. The device according to claim 12, further comprising air outlet elements that are distributed over the area of the cooling element and the air outlet elements are connected to at least one air supply line or a supply line for another gas.

16. The device according to claim 15, wherein an arrangement of air outlet elements and their number depend on the weight of the component; and wherein the number and distribution of the air outlet elements and the air pressure are matched to each other so as to ensure a reliable lifting of the component away from the cooling element.

17. The device according to claim 12, wherein the cooling fins are positioned in a box in such a way that an outer wall is formed, which prevents gas from flowing outward or downward; and further comprising an air cushion produced in such a way that pressurized gas is supplied between the fins to an underside of the blank or component.

* * * * *